US005375884A

United States Patent [19]

Farrington

[11] Patent Number: 5,375,884

[45] Date of Patent: Dec. 27, 1994

[54] ONE PIECE BOOKMARK

[76] Inventor: John Farrington, Box 224, Egartown, Mass. 02539

[21] Appl. No.: 3,395

[22] Filed: Jan. 12, 1993

[51] Int. Cl.[5] ..... B42D 9/00

[52] U.S. Cl. ..... 281/42

[58] Field of Search ..... 281/42, 51

[56] References Cited

U.S. PATENT DOCUMENTS

| | | | |
|---|---|---|---|
| D. 317,175 | 8/1989 | Dickson . | |
| 2,271,807 | 2/1942 | Shaughnessy | 281/42 |
| 2,576,783 | 11/1951 | Dewey | 281/42 X |
| 3,158,131 | 11/1964 | Salayka . | |
| 3,898,951 | 8/1975 | Ciare . | |
| 4,793,632 | 12/1988 | Hoffman . | |
| 4,848,799 | 7/1989 | Turetsky . | |
| 4,869,529 | 9/1989 | Hoffman . | |
| 4,932,351 | 6/1990 | Capamaggio | 251/42 X |
| 4,941,684 | 7/1990 | Frank . | |
| 5,022,342 | 6/1991 | Davis . | |
| 5,095,846 | 3/1992 | Knight | 281/42 X |

FOREIGN PATENT DOCUMENTS 2150077A 6/1985 United Kingdom .

*Primary Examiner*—Paul A. Bell

*Attorney, Agent, or Firm*—Choate, Hall & Stewart

[57] ABSTRACT

The present invention is a one-piece, attachable bookmark made of a flexible material, like molded plastic. The bookmark comprises: an attachment portion for removeably attaching the bookmark to a book; a long, narrow marking portion; a bendable thread section having a reduced cross-section with respect to the marking portion and extending between the attachment portion and the marking portion; and an optional decorative or functional end portion. The attachment portion may be a flexible U-shaped clip which fits snugly over a book spine and binding.

9 Claims, 2 Drawing Sheets

ONE PIECE BOOKMARK

BACKGROUND OF THE INVENTION

The present invention pertains to the field of bookmarks generally and specifically to removeably attacheable bookmarks.

Many methods and devices exist for marking a page in a book to which a reader wishes to return at a later time, so that the reader need not memorize the page number. For instance, a reader may fold down the corner of the page, thereby wearing down the corner so that it is susceptible to being torn. A reader may also use a conventional bookmark consisting of a thin strip of paper or fabric, or other object, which is unattached to the book and placed between the pages of a book at the page to be marked. A conventional bookmark can slip out of a book and be lost.

Some bookmarks are permanently or removeably attached to a book to avoid the bookmark's dislodgement from the marked page and its loss. For instance, some hardcover books and diaries have a ribbon bookmark with one end permanently sewn or glued to the book spine. Separate ribbon-like bookmarks also exist which may be removeably attached to a book spine or cover. Turetsky, U.S. Pat. No. 4,848,799 (Jul. 18, 1989), provides a ribbon bookmark which attaches to a book's spine or cover by an adhesive tape. Clare, U.S. Pat. No. 3,898,951 (Aug. 12, 1975), provides a stretchable fabric or elastic bookmark having a closed loop at one end which fits around a book cover, and another end serving as the page marker.

More relevant to the present invention are those designs which attach book marks to a book by means of clips. For instance, there are bookmarks which clip to the top of a book spine or cover, and have arms extending along the tops of the pages with small, resilient marker tabs at the end of the arms which insert between the pages. The marker tabs generally do not extend down the length of the page, as do conventional bookmarks, and are fairly rigid in construction. See, e.g., Salayka, U.S. Pat. No. 3,158,131 (Nov. 24, 1964), and Hoffman, Jr., U.S. Pat. Nos. 4,793,632 and 4,869,529 (respectively, Dec. 27, 1988 and Sep. 26, 1989); Frank et al., U.S. Pat. No. 4,841,684 (Jul. 17, 1990). These bookmarks have a number of working components which must be made separately and then secured together.

Other removeably attachable bookmarks exist which function more like conventional bookmarks, with the marker fitting between book pages along the entire length of the book. Rocchelli, U.K. Patent GB 2 150 077 (Jun. 26, 1985), discloses a bookmark of multiple uses which can mark several pages as well as particular lines. His bookmark clips onto a book spine or cover by a "securing element" (either an elastic straddling member or wire clip), to which is attached several thread- or ribbon-like page markers each having sliding line markers. Davis, U.S. Pat. No. 5,022,342 (Jun. 11, 1991), provides a similar style of bookmark, comprising several strings as page markers and moveable beads or tabs as line markers. The strings are secured to an anchor, consisting of either a VELCRO® fastening or a spring clamp attachable to a book spine. The disadvantage of Davis's VELCRO® fastening is that one part of the fastening must be affixed to the signature of the book, which may damage the book's surface. Furthermore, both Rocchelli's and Davis's bookmarks are relatively complex with multiple components, and hence labor-intensive and expensive to manufacture.

A need exists for a bookmark which is removeably attachable to a book, yet is relatively inexpensive and simple to make.

SUMMARY OF THE INVENTION

The present invention is a one-piece, attachable bookmark which is inexpensive, simple to manufacture, and non-injurious to the book. Specifically, the one-piece bookmark is made of a flexible material, like molded plastic, comprising an attachment portion for removeably attaching the bookmark to a book; a long, narrow marking section; a bendable thread section linking the attachment and marking portions and having a reduced cross-section relative to the marking section; and an optional decorative end portion contiguous with the marking section. It is preferred that the attachment portion is a flexible clip configured to fit snugly over a book binding, alone or with a book spine.

DESCRIPTION OF THE PREFERRED EMBODIMENT

Figure 1:
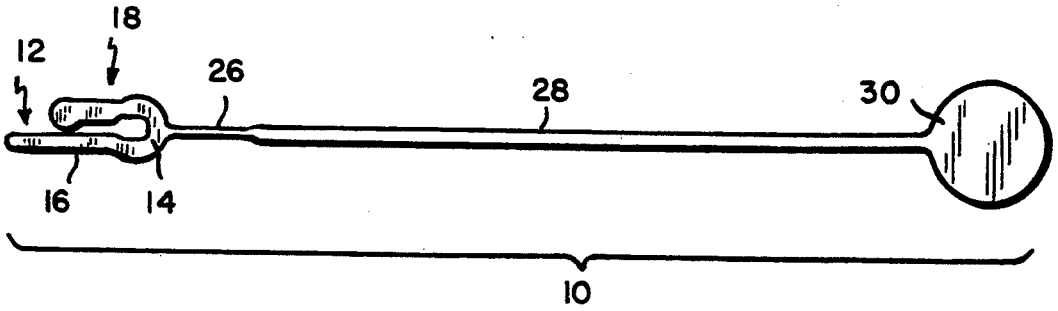
FIG. 1 is a top view of a bookmark of the invention.
Figure 2A:
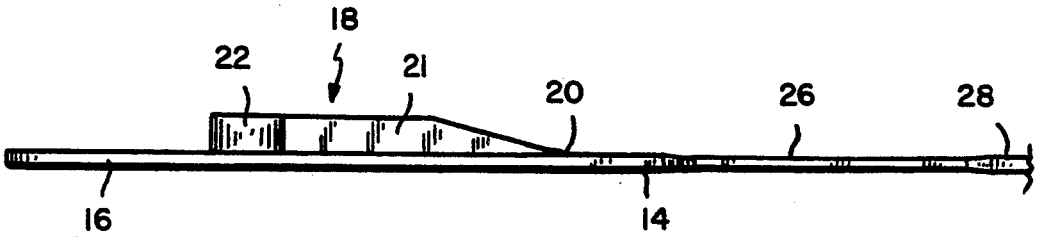
FIG. 2(*a*) and (*b*) are enlarged side and top views, respectively, of the bookmark's clip.
Figure 2B:
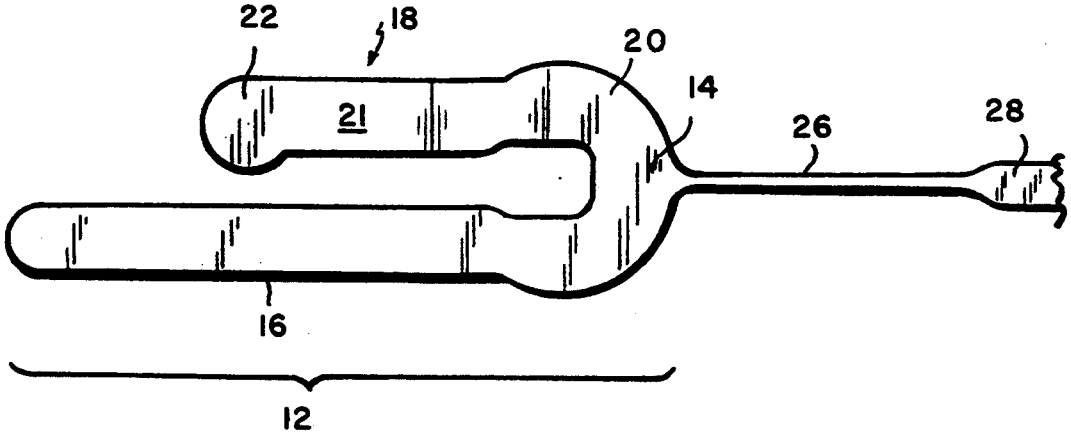
Figure 3A:
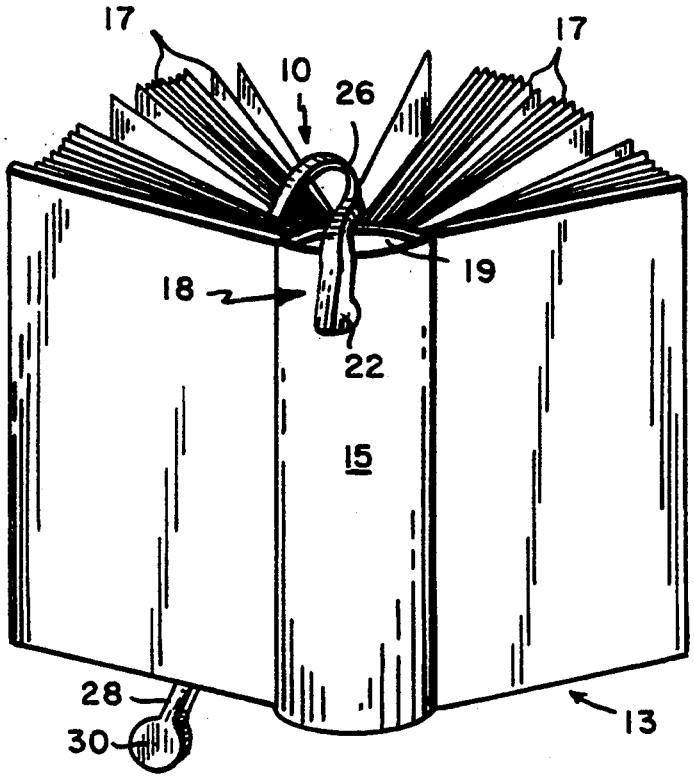
FIGS. 3 depicts perspective views of, respectively, the (a) exterior and (b) interior of a book marked by the present bookmark.
Figure 3B:
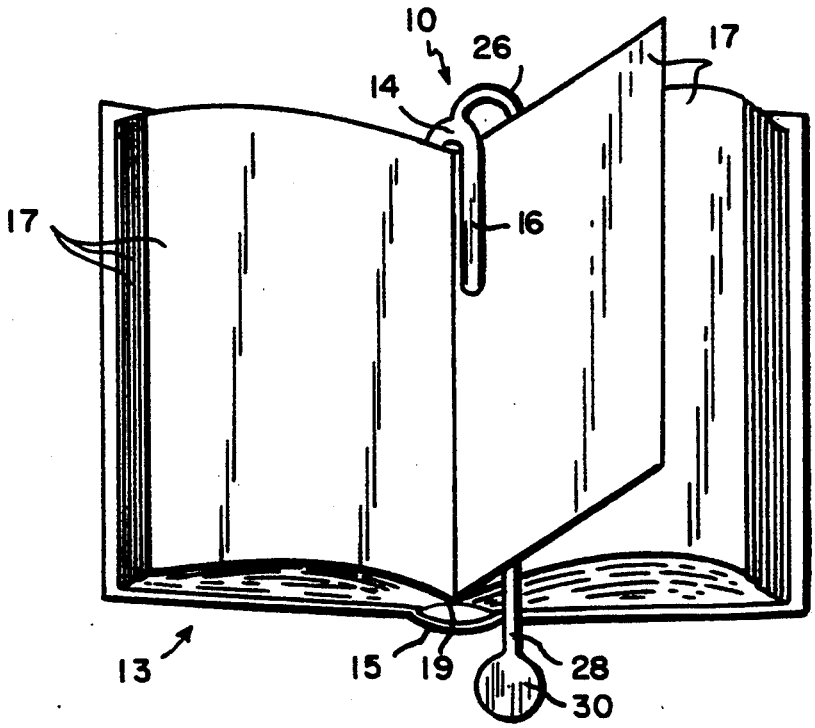

Referring generally to FIGS. 1–3, the preferred embodiment of the one-piece bookmark 10 is made of a long strip of flexible material, preferably molded plastic, but rubber or the like could be used as well. The bookmark 10 has a first end comprising an attachment portion, preferably a U-shaped clip 12, by which the bookmark 10 can removeably attach to a book 13. The clip 12 comprises a flat arch 14 connecting an inner arm 16 and an outer arm 18, the inner edges of which are adapted to fit snugly over a book spine 15 and a binding 19 (e.g., in a small hardcover or a paperback book), as shown in FIG. 3(*a*), or over a binding 19 alone (e.g., in a thick hardcover book). The inner arm 16 is flat and elongated, and can be anchored flat in the book's interior between two book pages 17 along the binding 19. The outer arm 18 is shorter than the inner arm 16 and designed to rest outside against the book spine 15. It has a flat proximal end 20 contiguous with the flat central arch 14. Viewed from the side, the outer arm 18 gradually thickens from the proximal end 20 into a thick middle section 21, which continues into a similarly thick, rounded distal end 22 protruding laterally towards the inner arm 16. As shown in FIGS. 4(*a*) and (*b*), the configuration and flexibility of its arms 16 and 18 enable the clip 12 to grasp the book spine 15 and binding 19. The bookmark 10 does not easily slip off the book 13, especially when closed, due to: the surface friction between the marking section 28 and the book page 17; and the snug fit of the arms 16 and 18 over the book binding 19 and/or book spine 15.

Referring to FIGS. 1 and 2, the top of the clip's arch 14 is contiguous with a flexible thread portion 26 which continues into a first end of a wider marking section 28. The bookmark 10 can bend upon itself at thread section 26 due to the latter's reduced cross-section, with respect to the wider marking section 28. As a result, the marking section 28 will readily lie flat along a book page 17.

The marking section 28 may be longer than a book page 17, to help the user to locate the marked book page. At least two lengths of bookmark embodiments are possible: the average length of a paperback and that of a hardcover book.

A second end of the bookmark 10 comprises an end portion 30 of the marking section 28. This end portion 30 may be plain or, as shown in FIG. 1, consist of a decorative shape such as a round medallion or a useful object. Ornamentation or writing may also be displayed on the end portion 30. Referring to FIG. 3, when the bookmark's clip 12 is affixed to the book 13, its thread portion 26 can fold over, allowing the marking section 28 to lie flat between and along the length of book pages 17 and the end portion 30 to protrude from the bottom of the book 13.

By way of example, the present bookmark 10 and its components may have the following general dimensions. The embodied bookmark 10 has a total length of 12", from clip 12 to decorative end portion 30, which fits most paperbacks and small hardcover books. The bookmark's thread section 26 or marking section 28 may be lengthened to span the length of larger books or journals. In the clip 12, the central arch 14 is approximately 0.25" long, 0.048" thick, and 0.37" wide at its widest point where it joins the arms 16 and 18. The inner arm 16 is 0.048" thick, 1.5" long, and 0.14" wide. The outer arm 18 is 1.01" long and 0.14" wide, and gradually thickens from a 0.048"-thick proximal end 20 to a 0.188"-thick distal end 22. The arms 16 and 18 are generally spaced 0.094" apart, but are only 0.047" apart where the distal end 22 of outer arm 18 protrudes toward inner arm 16. The widest point of the rounded distal end 22 is 0.61" wide. The thread section 26 is approximately 0.032" thick and 0.75" long. The marking section 28 is 0.125" wide and about 8" long. In the illustrated embodiment, the end portion 30 is a circular medallion having a 1.12" diameter.

It is understood by one skilled in the art of bookmarks that the present bookmark can encompass other configurations, materials, and ornamentation without altering the essence of the invention: the bookmark's non-damaging attachability to a book and its flexible one-piece construction. For instance, the thread portion 26 may be attached to the outer arm 18 rather than the arch 14 of the clip 12. The clip 12 may be adapted to attach to book cover, rather than fitting over both a book spine and/or binding. The attachment portion may also be formed more as a clamp, with greater surface area than the clip 12. The bookmark 10 may be formed of a stretchable rubber. The end portion 30 may even be formed as a flexible ring or coil to hold a pencil or marker.

The invention is claimed as follows:

1. A one-piece bookmark made of flexible, molded material, comprising:

an attachment portion for removably attaching the bookmark to a book;

a long, narrow marking portion; and a bendable thread section having a reduced cross-section with respect to the marking portion, and extending between the attachment portion and the marking portion, the bendable thread section being capable of reversible bending into a conformation that allows the marking portion to lie flat between and along the length of book pages when the attachment portion is attached to the book; and an end portion contiguous with the marking section.

2. The one-piece bookmark of claim 1, wherein the attachment portion comprises a clip.

3. The one-piece bookmark of claim 1, wherein a gripping surface of the attachment portion is substantially U-shaped and configured to fit snugly over a book binding.

4. The one-piece bookmark of claim 3, wherein an inner arm of the U-shaped attachment portion is flat and can lie between two book pages, next to a book binding, and wherein an outer arm of the U-shaped attachment is thicker and shorter than the inner arm and can rest snugly against an exterior of a book spine.

5. The one-piece bookmark of claim 2, wherein the end portion is a decorative shape.

6. The one-piece bookmark of claim 1, 3, or 4, wherein the flexible, molded material is plastic.

7. The one-piece bookmark of claim 1, 3, or 4, wherein the flexible, molded material is rubber.

8. The one-piece bookmark of claim 1, wherein the marking section has a length adapted for a standard paperback book.

9. The one-piece bookmark of claim 1, the marking section has a length adapted for a standard hardcover book.

* * * * *